United States Patent [19]

Iwasaki

[11] 4,264,227

[45] Apr. 28, 1981

[54] PRESS-OUT TYPE WRITING TOOL

[76] Inventor: Kosei Iwasaki, 2-48-15, Horikiri, Katsushika-ku, Tokyo, Japan

[21] Appl. No.: 953,919

[22] Filed: Oct. 23, 1978

[30] Foreign Application Priority Data

Apr. 28, 1978 [JP] Japan ..... 53-51280

[51] Int. Cl.[3] ..... B43K 21/22

[52] U.S. Cl. ..... 401/94; 401/67; 401/84; 401/89

[58] Field of Search ..... 401/58, 62, 63, 67, 401/82, 83, 84, 86, 87, 89, 90, 91, 92, 93, 94, 53

[56] References Cited

U.S. PATENT DOCUMENTS

| | | | |
|---|---|---|---|
| 246,961 | 9/1881 | Livermore | 401/82 |
| 261,500 | 7/1882 | Uhlig | 401/53 |
| 268,355 | 11/1882 | Boman | 401/62 |
| 302,786 | 7/1884 | Shipley | 401/58 |
| 1,236,069 | 8/1917 | Duryea | 401/89 |
| 1,426,131 | 8/1922 | Waring | 401/67 |
| 1,447,678 | 3/1923 | Lindberg | 401/67 |
| 1,659,533 | 2/1928 | Lynn | 401/87 |
| 1,736,568 | 11/1929 | Aulmann | 401/93 |
| 1,830,043 | 11/1931 | Vail | 401/63 |
| 2,179,835 | 11/1939 | Ward | 401/67 |
| 2,203,160 | 6/1940 | Kovacs | 401/67 |
| 2,528,328 | 10/1950 | Baker | 401/86 |
| 2,865,330 | 12/1958 | Swank | 401/53 |
| 4,106,874 | 8/1978 | Torii | 401/67 |

FOREIGN PATENT DOCUMENTS

| | | | |
|---|---|---|---|
| 170153 | 1/1952 | Austria | 401/67 |
| 8111 | 11/1879 | Fed. Rep. of Germany | 401/90 |
| 63183 | 7/1892 | Fed. Rep. of Germany | 401/94 |
| 514224 | 12/1930 | Fed. Rep. of Germany | 401/53 |
| 1066103 | 9/1959 | Fed. Rep. of Germany | 401/67 |
| 2034500 | 2/1971 | Fed. Rep. of Germany | 401/94 |
| 925353 | 3/1947 | France | 401/67 |
| 58757 | 11/1953 | France | 401/90 |
| 219430 | 5/1942 | Switzerland | 401/67 |
| 278014 | 12/1951 | Switzerland | 401/67 |
| 10026 | of 1887 | United Kingdom | 401/62 |
| 144095 | 6/1920 | United Kingdom | 401/90 |

*Primary Examiner*—Clyde I. Coughenour

*Attorney, Agent, or Firm*—Eyre, Mann, Lucas & Just

[57] ABSTRACT

A press-out type writing tool having a holder body and a mechanism disposed in the holder body for pressing out pencil lead. The mechanism includes a depressing tube, a chuck for clamping the lead and a lead clamp. The lead clamp is formed separately from the chuck and is adapted to come in and out of an end opening of the holder body, while clamping the lead. The lead clamp projects out of the lower opening of the holder body, when the tool is used for the writing purpose, and is adapted to make up the required projection length of the lead as the latter wears. When the tool is not used, the lead clamp is retracted to disappear into the holder body, along with the lead which is clamped by the lead clamp, so as to protect the lead against any external force which may incur the breakage of the lead. The upper end of the lead clamp in the retracted state is received by an enlarged hole formed in the lower end of the chuck, so as to make the chuck release the lead. Since the lead in this state is clamped solely by the lead clamp, breakage of the lead attributable to a too strong gripping by the chuck is avoided. The condition of holding of the enlarged portion of the lead clamp by the chuck is never changed by any external force or impact applied to the holder body. The number of parts constituting the lead clamp is reduced to simplify the construction and to facilitate the assembling, thereby to ensure a trouble-free and stable use of the writing tool.

3 Claims, 8 Drawing Figures

PRESS-OUT TYPE WRITING TOOL

BACKGROUND OF THE INVENTION

The pressent invention relates to a push-out type writing tool having a lead of pencil adapted to be pushed out of a tubular holder body.

Various push-out type writing tools have been proposed and used, among which the most popular one has a lead chuck which is normally projected out from the opening end of the tubular holder body and adapted to be engaged by the brim of end opening of the tubular holder body so as to tightly clamp the lead. Another writing tool of this type has, as is the case of the present invention, a lead chuck completely received by the tubular body of the tool. A tightening ring for tightening and releasing the lead chuck is disposed in the tubular holder body for movement together with the lead chuck. The tightening ring is adapted to be engaged, as it is moved within the tubular holder body along with the lead chuck, by central bores of large and small diameters formed in the tubular holder body, so as to tighten and release the chuck. When the chuck is released from the tightening force exerted by the tightening ring, it releases the lead so as to allow the latter to move freely in the axial direction.

The second-mentioned writing tool can be sorted further into two types. One of them allows only the lead to come out of the opening end of the tubular holder body, while, in the other type, a lead clamp, which is provided separately from the lead chuck, is adapted to come out of the end opening of the tubular holder body.

The present invention is concerned with an improvement in the writing tool of the second-mentioned type having a lead clamp provided separately from the lead chuck.

SUMMARY OF THE INVENTION

As mentioned above, the present invention relates to a press-out type writing tool having a lead chuck completely received by the tubular holder body and a lead clamp separate from the lead chuck and, more particularly, to an improvement in the construction of the lead clamp.

According to the invention, the lead clamp is constituted by a clamp tube for clamping the lead and an outer sleeve associated with the clamp tube. The lower portion of the lead clamp is formed into opposing resilient clamping pieces adapted to resiliently clamp the lead at its lower end. The outer sleeve is secured to the outer periphery of the clamp tube, and is provided with peripheral annular abutting portion. The bore in the lower portion of the outer sleeve has a diameter large enough to allow the clamping portion of the lead clamp to open. The outer sleeve is adapted to be moved together with the clamp tube within the holder body, in the axial direction of the latter, so as to come in and out of the end opening of the holder body. The outer sleeve has an expanded portion adapted to be received by an enlarged hole formed in the lower end surface of the chuck, when it is retracted into the holder body, so as to make the chuck release the lead. If the chuck continues to clamp the lead, it may break the lead when an external force is applied to the chuck because of too strong gripping force. However, according to the invention, such a breakage is fairly avoided because the chuck releases lead. Further, the speed of pressing out of the lead for the writing is increased. At the same time, the projection length from the lower end opening of the holder is made constant thanks to the provision of the outer sleeve. The number of parts is reduced to save the material and lower the manufacturing cost. At the same time, the construction is simplified to render the tool free from trouble. Further, as the lead is worn down, new spare leads are successively supplied. Consequently, the troublesome work of removing the worn down lead is eliminated. Thus, a press-out type writing tool having an improved reliability and capable of standing longer use is provided.

DESCRIPTION OF THE PREFERRED EMBODIMENTS

Figure 1:
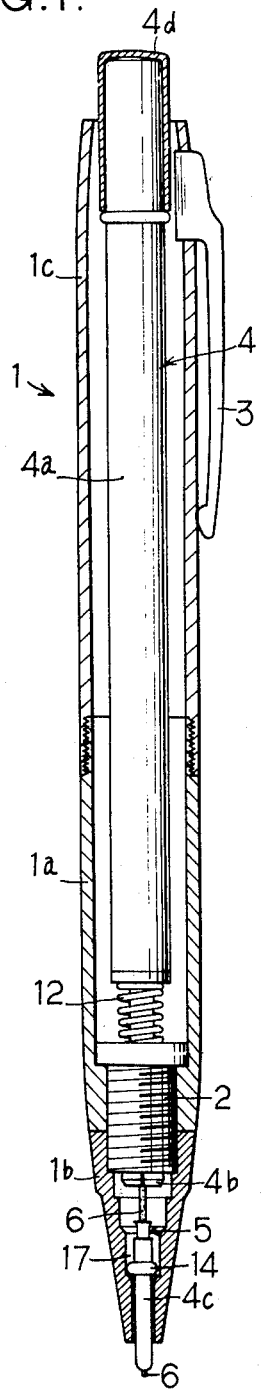
FIG. 1 is a front elevational view of the whole part of a writing tool embodying the invention, in which a tubular main body is shown in section.

Hereinafter, the practical construction of the writing tool in accordance with the invention will be described with reference to the drawings.

Referring to the drawings, a holder body is generally designated at a reference numeral 1. The holder body has a main shaft 1*a* and an end portion 1*b* of the main shaft 1*a* the lower end of which constitutes a part of the main holder member 1*a*. The end portion 1*b* has a conical shape having a lower reduced diameter portion. Both members are connected to each other by means of a screw sleeve 2. Further, the holder body 1 has an upper holder member 1*c* provided with a clip 3 and screwed to the main shaft 1*a*.

A reference numeral 4 denotes a press-out mechanism as a whole, which includes a depressing tube 4*a* accomodating a number of leads, a chuck 4*b* provided at the lower end of the depressing tube 4*a*, a lead clamp 4*c* disposed beneath the chuck, and a small cap 4*d* adapted to be depressed by a finger and secured to the upper end of the depressing tube 4*a*. The small cap 4*d* projects slightly out of the upper holder member 1*c* of the holder body 1.

The critical feature of the invention resides in an improvement in the construction of the lead clamp 4*c*, as will be seen from the following description.

Figure 3:
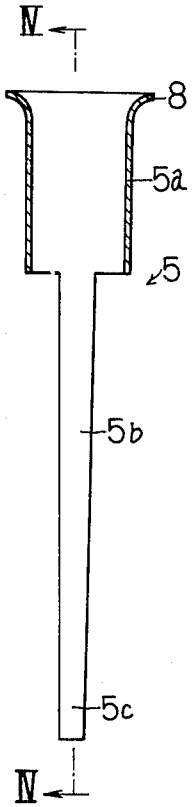
FIG. 3 is a front elevational view of a lead clamp tube and a portion around the same.
Figure 4:
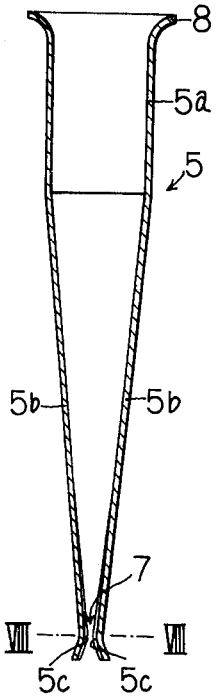
FIG. 4 is a longitudinal sectional side elevational view of the lead clamp tube as shown in FIG. 3.

More specifically, as will be seen from FIG. 3, a lead clamp body 5 for clamping the lead of the pencil has an upper tubular end portion 5*a*. A pair of elongated resilient pieces 5*b* are formed at the lower end portion of the tubular end portion 5*a*. The resilient piece has a width which is gradually narrowed toward the lower end thereof, so as to exhibit a large resiliency. As shown in FIG. 4, the lower ends of these resilient pieces are brought together in a resilient manner. At the same time, a clamping portion 7 having an arcuate surface following the curvature of the outer peripheral surface 5c is formed in the lower end of the resilient piece.

Figure 2:
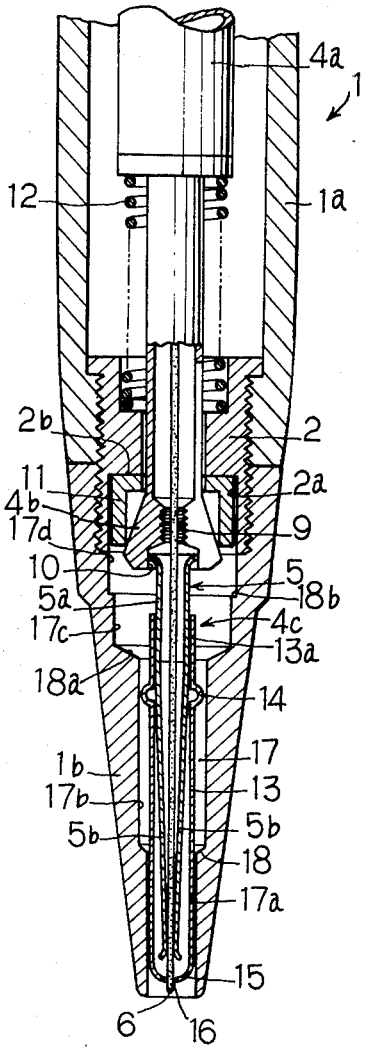
FIG. 2 is a longitudinal sectional view of an essential part of the writing tool.

The opening brim of the tubular portion 5a is expanded outward, so as to form an expanded portion 8. At the same time, as shown in FIG. 2, an enlarged hole 10 is formed concentrically with a central bore 9 for clamping the lead 6, in the lower surface of an enlarged head portion of the chuck 4b.

The arrangement is such that the chuck 4b opens the central bore 9 as it is released from a tightening ring 11, when the depressing tube 4a is depressed, so as to release the lead 6. In the reverse movement, the lead clamp 4c as a whole is retracted into the holder body 1, so that the expanded portion 8 comes to be received by the enlarged hole 10 and is gripped by the chuck 4b. The lead clamp 4c is kept in the retracted condition while its clamping portion 7 clamping the lead 6. Thus, the lead 6 is clamped by the clamping portion 7 of the resilient pieces 5b provided on the clamp body 5 of the lead clamp 4c. Consequently, the breakage of the lead 6 is conveniently avoided.

Supposing that the lead 6 is clamped solely by the chuck 4b, the chuck 4b is lifted by the force of a spring 12. At the same time, the movement of the tlightening ring 11 is limited by an inner step 2b of a bore 2a of the screw sleeve 2, so that the chuck is tightened to hold the lead 6 at its central bore 9. Consequently, the lead 6 is broken when an extraordinarily large external force is imparted. However, according to the invention, the impacting external force is conveniently absorbed by the resilient pieces 5bwhich support the lead 6, so as to prevent the latter from being broken. Another advantage of the invention resides in that the entering of the lead clamp body 5 into central bore 9 of the chuck 4b, which often causes troubles, is avoided thanks to the provision of the enlarged portion 8 of the clamp body 5.

Figure 5:
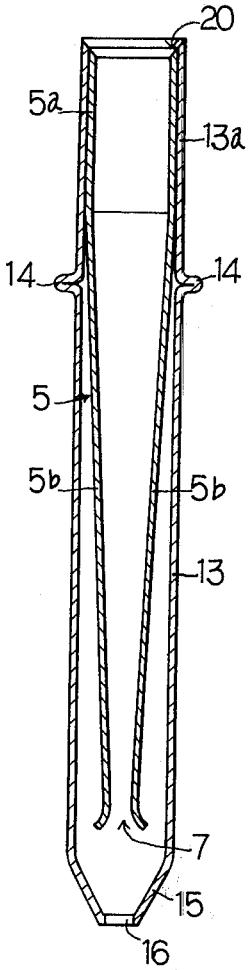
FIG. 5 is an enlarged longitudinal sectional view of a modified lead clamp specifically showing the modified portion.

Referring now to FIG. 5, an outer sleeve 13 of the lead clamp 4c has an upper end 13a which is tightly fitted to the outer periphery of the tubular portion 5a of the lead clamp 5. An annular projection 14 is provided at the upper portion of the outer sleeve 13. The lower portion of the outer sleeve 13 is reduced to form a cylindrical part 15 of a reduced diameter. A port 16 through which the lead 6 comes in and out is formed in the lower end of the cylindrical part 15. The upper end of the cylindrical part 15 is at a position slightly below the clamping portion 7 of the clamp body 5, so as to preserve a radial clearance necessary for opening to the clamping portion 7.

Figure 6:
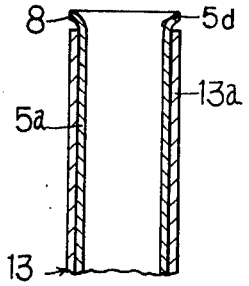
FIG. 6 is a sectional view of a portion of another embodiment which is a modification of the lead clamp as shown in FIG. 5.
Figure 7:
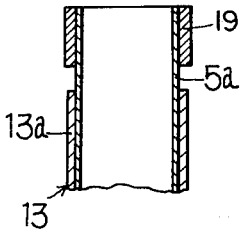
FIG. 7 is a longitudinal sectional view of still another embodiment.
Figure 8:
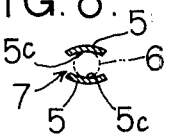
FIG. 8 is a secational view along the line VIII—VIII of FIG. 4.

FIGS. 5 to 7 show different forms of the clamp body 5 of the lead clamp 4 and the outer sleeve 13 in relation to the expanded upper end portion 8. In FIGS. 5 and 6, the outer sleeve 13 is made to have a larger diameter corresponding to the expanded portion 8. The outer sleeve 13 is adapted to be gripped at its upper end 13a by the chuck 4b. In FIG. 5, the upper end opening 20 of the tubular end portion 5a and the outer sleeve 13 have tapered surfaces, so as to facilitate the insertion of the lead 6.

Similarly, in FIG. 6, the upper end 5d of the tubular portion 5a is bell-mouthes within the diameter of the outer sleeve 13, for the same purpose. Further, in FIG. 7, a ring 19 having a large thickness and secured to the upper outer periphery of the tubular portion 5a is used in place of the expanded portion 8.

The projection 14 of the outer sleeve 13 is provided for limiting the projecting length (see FIG. 1) of the outer sleeve 13 from the end 1b of the holder body 1. The central bore 17 in the end portion 1b has a bore 17a for receiving the outer sleeve 13, a central bore 17b having a larger diameter than the projection 14, and larger diameter bores 17c, 17d. Due to the difference of the diameters, steps 18, 18a and 18b are formed on the inner peripheral wall of the central bore 17. The step 18 is adapted to engage the projection 14, so as to determine the projecting length of the outer sleeve 13, i.e. the projecting length of the lead clamp 4c.

When the depressing tube 4a is depressed, the downward movement of the chuck 4b is limited, because the tightening ring 11 comes to abut the step 18b. As the depressing tube 4a is depressed further, the chuck 4b comes to received by the central bore 17c, so as to be opened to release the expanded portion of the lead clamp 4c. Consequently, the lead clamp falls down due to the force of gravity, until the projection 14 comes to abut the step 18.

What is claimed is:

1. In a clutch-type press-out writing tool of the type having a depressing tube cooperating with a chuck for holding and releasing a lead, a lead-clamping mechanism comprising a lead clamp body; said lead clamp body having a tubular portion, the upper end of which flares outwardly to form a radially outwardly expanded portion and the lower end of which is formed to include two opposing resilient pieces, said resilient pieces drawing near to each other along the central axis of the tubular portion as the end of the tubular portion is approached, thereby forming a resilient clamping portion for clamping a lead at the end of the tubular portion;

an outer sleeve which is separately formed such that the inner diameter thereof corresponds to the outer diameter of said tubular portion, said outer sleeve having an annular projection formed on its outer periphery at the upper end thereof, the lower end of said outer sleeve being reduced in diameter to form a port through which the lead passes in and out;

said tubular portion fitting tightly into the inner circumference of said outer sleeve at the upper end thereof when said tubular portion including said resilient clamping portion is inserted into said outer sleeve;

said lead clamp body being inserted into a central bore located in an end portion which is screwed onto the lower end of a cylindrical main shaft having said chuck housed therein, in which, in a first position of said lead clamp body, the lower end of said lead clamp body is projected outwardly from an opening in said end portion and said projection abuts against a stepped portion formed in the central bore of said end portion to retain the upper end of said lead clamp body within said central bore, and in a second position, the entire lead clamp body is retracted into the central bore in said end portion, with said radially outwardly expanded portion of said lead clamp body being fitted into and retained by a recess formed in said chuck so that said lead clamp body is held in said central bore in said end portion.

2. A clutch-type press-out writing tool according to claim 1 further comprising a ring fixedly attached on said upper end said upper end being enlarged by said ring.

3. A clutch-type press-out writing tool according to claim 1 wherein said upper end is thickened to a diameter corresponding to the upper end of said outer sleeve.

* * * * *